US005249605A

United States Patent [19]

Graf

[11] Patent Number: 5,249,605

[45] Date of Patent: Oct. 5, 1993

[54] HEDDLE FRAME WITH VIBRATION DAMPER ELEMENT

[75] Inventor: Martin Graf, Horgenberg, Switzerland

[73] Assignee: Grob & Co. Aktiengesellschaft, Horgen, Switzerland

[21] Appl. No.: 793,348

[22] PCT Filed: May 10, 1990

[86] PCT No.: PCT/CH90/00125

§ 371 Date: Jan. 10, 1992

§ 102(e) Date: Jan. 10, 1992

[87] PCT Pub. No.: WO91/17291

PCT Pub. Date: Nov. 14, 1991

[51] Int. Cl.[5] ..... D03C 9/06

[52] U.S. Cl. ..... 139/91

[58] Field of Search ..... 273/73 J; 139/91, 92

[56] References Cited

U.S. PATENT DOCUMENTS 3,895,655 7/1975 Sujdak et al. ..... 139/92

4,390,045 6/1983 Baumann ..... 139/91

4,741,367 5/1988 Kitawaki ..... 139/91

4,907,810 3/1990 Whiteford ..... 273/73 J

*Primary Examiner*—Andrew M. Falik

*Attorney, Agent, or Firm*—Nies, Kurz, Bergert & Tamburro

[57] ABSTRACT

A projection extending from a side support for defining a detachable edge connection at the heddle frame, which detachable edge is clamped down by a clamping screw carried in a hollow frame stave. A vibration damper element is positioned between the side support and the projection and is connected thereto preferably by bonding. The vibration damper element is an elastomer and has a strip-like shape having a width corresponding with the width of the side support. The side support is connected to the frame stave at each edge connection via the vibration damper element, and vibrations occurring in high speed weaving machines, which vibrations can lead to material ruptures at the side support, are dampened.

8 Claims, 2 Drawing Sheets

HEDDLE FRAME WITH VIBRATION DAMPER ELEMENT

BACKGROUND OF THE INVENTION

1. Field of the Invention

The invention relates to a heddle frame with detachable edge connections between the side supports and the frame staves consisting of hollow profiles, where at each edge joint a projection extending laterally from the side support engages peg-like into a hollow space in the frame stave and is clamped down by means of a screw.

2. Description of the Related Art

Heddle frames, which are oscillatingly moved in a weaving machine, are as generally known subject to a very high loading due to the continuous reversals of stress. The stress levels increase with the continuously improved weaving machines operating at increased rotational speeds, such that ruptures caused by the high loading occur at the side supports, and specifically below the peg-like projection. For weight reasons, heddle frames are nowadays made preferably of light metal, which type of material has, however, the property that the flexural strength of this material, drawn as curve, decreases steeply over a number of load changes to a certain load change value and then less steeply, but continuously. However, this is not the case with steel after having reached a certain limit value. Thus, in view of the above mentioned continuously decreasing flexural strength curve of light metal the rupture of parts made from such material can happen at any time due to the higher loading.

SUMMARY OF THE INVENTION

Thus, the present invention has as an object to prevent ruptures of heddle frame material by structural measures. In order to meet this object the heddle frame includes side supports having projections that are received in hollow spaces in frame staves with which the side supports are connected, the projections and the side supports being spaced by vibration damper elements.

By a vibration damper element in each edge connection between a side support and the frame stave of the heddle frame the vibrations caused by the frequent load changes are counteracted and the load peaks are no longer transmitted directly from one part to the other part.

BRIEF DESCRIPTION OF THE DRAWINGS

Various embodiments of the invention will be explained hereinbelow based on the drawings. There are illustrated in.

DESCRIPTION OF THE PREFERRED EMBODIMENTS

Figure 1:
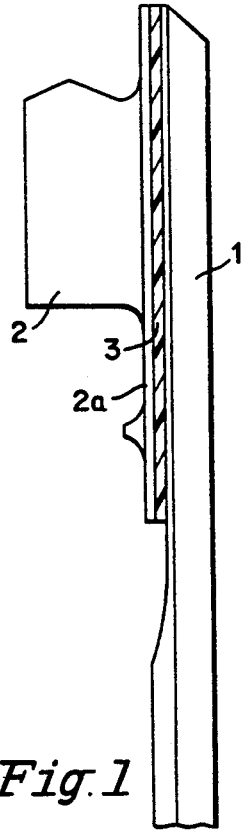
FIG. 1 and FIG. 2 show side views of two different embodiments of a side support with projection designed broken off.
Figure 2:
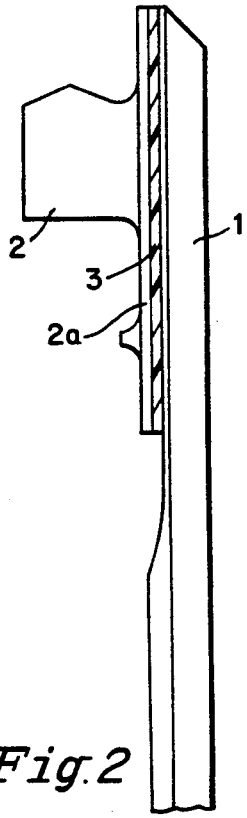
Figure 3:
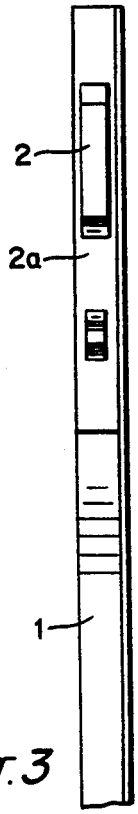
FIG. 3 shows the side support according to FIG. 2 viewed from the left side as shown in FIG. 2.
Figure 4:
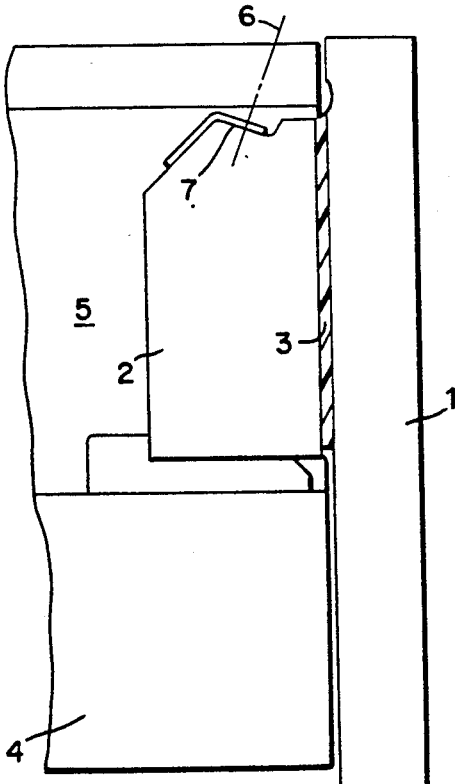
FIG. 4 shows the edge connection of a heddle frame, consisting of the side support in a further embodiment with the frame stave only partially shown.

At the one narrow side of the side support 1 of which only the upper end portion is illustrated in FIG. 1, a projection 2 is mounted which serves for connecting the side support 1 to a frame stave (not shown), which connection is termed an edge connection. One form of edge connection is illustrated in FIG. 4. The projection 2 serving as part of the connection includes in the FIG. 1 embodiment a planar base part 2*a* extending in the direction of the longitudinal axis of the side support 1. The purpose of base part 2*a* is to increase the area over which projection 2 abuts the vibration damper element 3. Damper element 3 is connected in a preferred manner by bonding to the side support 1 and to the projection 2 along mutually adjacent surfaces. The larger this vibration damper element is, the better is the effect to be obtained therewith. Because the vibrations caused by the high revolution operation of the machine are dampened it is possible to avoid in this way ruptures of the side support 1, which have occurred predominantly at the level of the lower edge of the projection 2. Preferably, an elastomer such as rubber or a rubber like material is used as vibration damper element 3. Polyurethane can also be used. The vibration damper material is in the form of a strip having a substantially uniform cross-section and can be mounted by cementing. The projection 2 in FIG. 2 is somewhat shorter in the vertical direction, but the design is otherwise the same as in FIG. whereby the view according to FIG. 3 reveals that the base part 2*a* is broader than the projection 2 that serve for connection of side support 1 to the frame stave (not shown).

FIG. 4 illustrates the connection of a side support 1 with a frame stave 4 of a heddle frame. Frame stave 4 includes a hollow space 5 with which the projection 2 at the side support engages. The connection is effected by a clamping action by means of a clamping screw 6, which is illustrated by its center line only, and which passes obliquely through the frame stave 4, relative to the longitudinal axis of side support 1, and into the chamfered upper edge 7 of the projection 2. At the base part of projection 2 illustrated in FIG. 4 the vibration damper element 3 is not longer than the projection 2, which is received in the hollow space 5 of the frame stave 4.

Because, as mentioned initially, the effect attainable is better with a substantially larger area vibration damper element, various embodiments are possible in which a vibration damper element 3 which has a longer total length is arranged between the side support 1 and the projection 2. In such embodiments side support 1 and projection 2 do not have uninterrupted, opposed plane parallel surfaces that are separated by the vibration damper element 3. The side support 1 and the projection 2 are in the examples according to FIG. 5 and 6, in other words, designed to engage with each other so that side support 1 is received in projection 2. In the example according to FIG. 5 a V-shaped groove is defined between support 1 and projection 2, and in the example according to FIG. 6 a U-shaped groove is defined between the limiting surfaces of the side support 1 and the projection 2, in which is positioned the vibration damping element 3.

Figure 5:
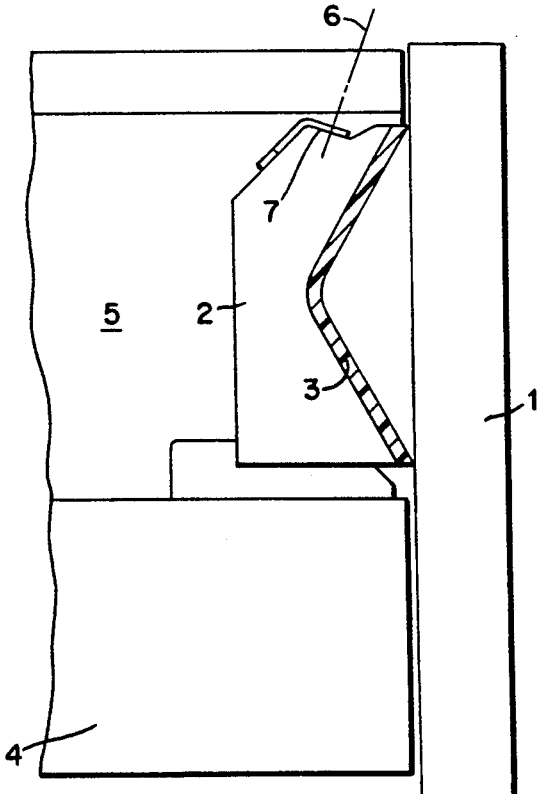
FIG. 5 and FIG. 6 show edge connections with modified embodiments of the side support and a non-planar vibration damper element.
Figure 6:
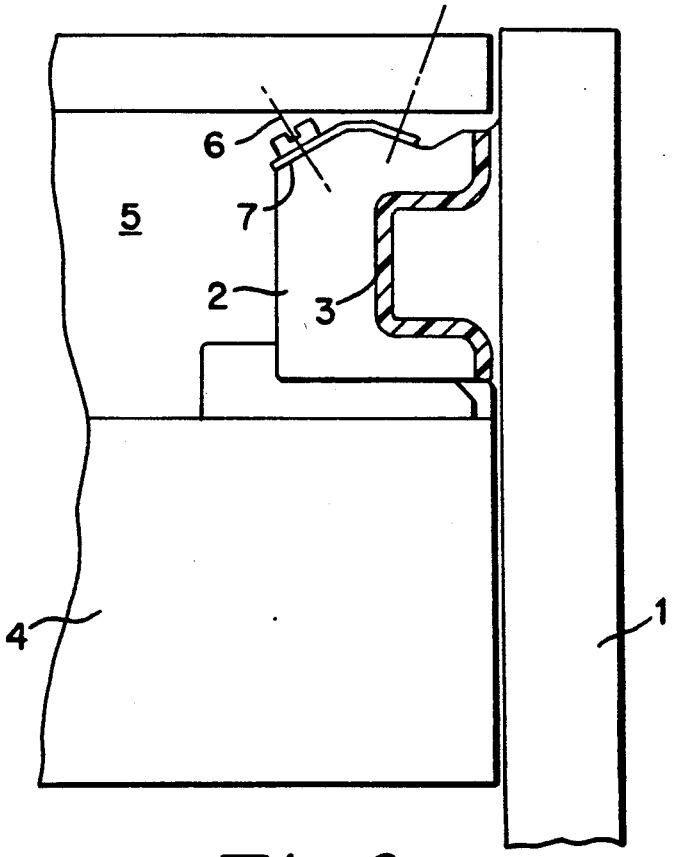
Figure 7:
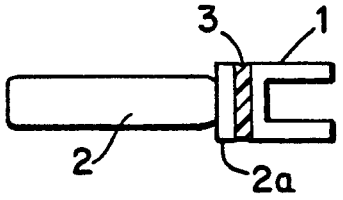
FIG. 7 and FIG. 8 are top views of two different forms of the side support with projection.
Figure 8:
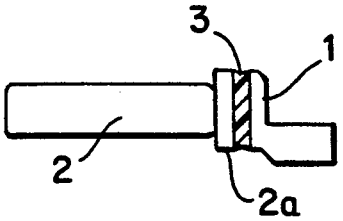

FIG. 7 and 8 illustrate views from above of a side support 1 and the projection 2 connected thereto, wherein projection 2 is narrower than the side support 1 such as to be able to be inserted into the hollow space 5 of the frame stave 4 (see FIGS. 4 and 5). The vibration damper element 3 in FIGS. 7 and 8 has the same width as the side support 1, which can have various profile shapes. The side support 1 acts at the same time as guide, whereby a U-shaped profile shape according to FIG. 7 embraces a guide rail (not shown) or according to FIG. 8 an L-shaped profile shape is received at one side by a guide groove (not shown).

What is claimed is:

1. A heddle frame including spaced side supports and frame staves extending between the side supports, the frame staves having hollow portions, said frame comprising a projecting member carried by and extending laterally from a vibration damper element attached to a surface of a mutually adjacent side support and received within a hollow portion of a frame stave, said vibration damper element positioned between and along at least the entire length of the mutually adjacent surfaces of the projecting member and the side support to space said member from said support.

2. A heddle frame according to claim 1, wherein the vibration damper element is a strip of elastomeric material having a substantially constant thickness.

3. A heddle frame according to claim 1, wherein the projecting member includes a planar base part having a length in a direction parallel to the side support greater than a corresponding dimension of the projecting member, and wherein the vibration damper element extends along substantially the entire planar base part of the projecting member.

4. A heddle frame according to claim 1, wherein the side support and the projecting member include opposed, non-planar surfaces between which the vibration damper is positioned to space the non-planar surfaces from each other.

5. A heddle frame according to claim 4, wherein the opposed surfaces are each V-shaped in cross section.

6. A heddle frame according to claim 4, wherein the opposed surfaces are each U-shaped in cross section.

7. A heddle frame according to claim 1, wherein the vibration damper is adherently mounted to each of the side support and the projecting member.

8. A heddle frame according to claim 1, wherein the vibration damper is cemented to the side support and to the projecting member.

* * * * *